US006679063B2

(12) United States Patent
Ebel

(10) Patent No.: US 6,679,063 B2
(45) Date of Patent: Jan. 20, 2004

(54) COMBUSTION CHAMBER HEAD FOR A GAS TURBINE

(75) Inventor: Michael Ebel, Rangsdorf (DE)

(73) Assignee: Rolls-Royce Deutschland Ltd & Co KG, Dahlewitz (DE)

( * ) Notice: Subject to any disclaimer, the term of this patent is extended or adjusted under 35 U.S.C. 154(b) by 0 days.

(21) Appl. No.: 09/968,491

(22) Filed: Oct. 2, 2001

(65) Prior Publication Data

US 2002/0038549 A1 Apr. 4, 2002

(30) Foreign Application Priority Data

Oct. 2, 2000 (DE) ..... 100 48 864

(51) Int. Cl.[7] ..... F23R 3/04; F23R 3/46

(52) U.S. Cl. ..... 60/798; 60/747; 60/752; 60/755; 60/748

(58) Field of Search ..... 60/796, 798, 800, 60/740, 746, 747, 748, 755, 756, 757

(56) References Cited

U.S. PATENT DOCUMENTS

| | | | | |
|---|---|---|---|---|
| 4,262,486 A | * | 4/1981 | Russell | 60/746 |
| 4,458,479 A | * | 7/1984 | Reider et al. | 60/800 |
| 5,129,231 A | | 7/1992 | Becker et al. | |
| 5,142,871 A | | 9/1992 | Lampes | |
| 5,289,687 A | | 3/1994 | Kress | |
| 5,331,815 A | | 7/1994 | Reinhold | |
| 5,419,115 A | | 5/1995 | Butler et al. | |
| 5,524,430 A | | 6/1996 | Mazeaud | |
| 5,623,827 A | * | 4/1997 | Monty | 60/748 |
| 5,924,288 A | | 7/1999 | Fortuna et al. | |
| 5,956,955 A | | 9/1999 | Schmid | |
| 5,996,335 A | | 12/1999 | Ebel | |
| 6,412,272 B1 | * | 7/2002 | Titterton et al. | 60/39.37 |

FOREIGN PATENT DOCUMENTS

| | | |
|---|---|---|
| DE | 2944139 | 5/1980 |
| DE | 19515537 | 10/1996 |
| DE | 4131069 | 5/1997 |
| EP | 0604021 | 6/1994 |
| EP | 0 841 520 | 5/1998 |
| EP | 0 927 854 | 7/1999 |
| GB | 2034874 | 6/1980 |
| GB | 2073401 | 10/1981 |
| GB | 2107448 | 4/1983 |
| GB | 2247522 | 3/1992 |

* cited by examiner

*Primary Examiner*—Ted Kim
(74) *Attorney, Agent, or Firm*—Davidson Berquist Klima & Jackson, LLP

(57) ABSTRACT

The present invention relates to a combustion chamber head for a gas turbine with at least one combustion chamber wall 2,3, a metering panel 1, at least one heat shield 4, at least one sleeve 5 and a cowling 6, characterized in that the metering panel 1 forms one part with the combustion chamber outer wall 2 and the combustion chamber inner wall 3, in that the heat shield 4 is mounted onto the metering panel 1 from the downstream side of the metering panel 1, in that the sleeve 5 is mounted to the metering panel 1 from the upstream side, and in that the cowling 6 is separably attached to the metering panel 1.

23 Claims, 6 Drawing Sheets

COMBUSTION CHAMBER HEAD FOR A GAS TURBINE

BACKGROUND OF THE INVENTION

This application claims priority to German Patent Application 10048864.1 filed Oct. 2, 2000, which application is incorporated by reference herein.

This invention relates to a gas turbine with at least one combustion chamber, a combustion chamber wall, a metering panel, at least one heat shield, at least one sleeve and a cowling.

Various designs of combustion chamber heads are known in the state of the art. For example, combustion chambers are of the one-part annular type made up of several, inseparably connected components. The main components are the inner and the outer combustion chamber wall and the combustion chamber head. The combustion chamber head is either made as a single component, for example by casting, or of different components, such as sheet-metal fabrications, turned parts etc.

Known combustion chamber heads are taught in Specifications EP 841 520 A2, U.S. Pat. No. 5,524,430, EP 927 854 A2, U.S. Pat. No. 5,289,687 or U.S. Pat. No. 5,331,815.

Besides the one-part designs, combustion chamber heads are known which are made up of individual components joined together by bolt-type fastenings or similar means.

The known designs generally are characterized by a high assembly effort. In particular, assembly of the heat shield together with the sleeves to the metering panel is difficult with some of the known designs since it must be performed from the exit side of the combustion chamber. This involves a considerable increase of the assembly costs.

Furthermore, the known combustion chamber heads have zones which are problematic in terms of the supply of cooling air, these problems arising from the circumstance that the individual components may compromise the supply of cooling air to the heat shield in certain zones.

In the design known from EP 841 520 A2, the sleeve and the heat shield form a unit and are assembled together on the metering panel from the exit of the combustion chamber. In this design, the surface of the sleeve which faces the combustion chamber interior is liable to considerable heating and cannot be cooled effectively.

BRIEF SUMMARY OF THE INVENTION

In a broad aspect, the present invention provides a combustion chamber head of the type specified at the beginning which combines simplicity of design and easy and cost-effective manufacture and assembly with the capability of effective cooling of the heat shield.

It is a particular object of the present invention to provide a combustion chamber head for a gas turbine, comprising: a combustion chamber outer wall; a combustion chamber inner wall; a metering panel; at least one heat shield; at least one sleeve; and a cowling; wherein the metering panel is formed as a unitary part with the combustion chamber outer wall and the combustion chamber inner wall, the heat shield is mounted to the metering panel from a downstream side of the metering panel, the sleeve is mounted to the metering panel from an upstream side of the metering panel, and the cowling is removably attached to the metering panel. Further objects and advantages of the invention will be apparent from the description below.

The combustion chamber head according to this invention is characterized by a variety of merits.

According to the present invention, the heat shield is mounted to the metering panel from the downstream side, whilst all other components are fitted from the upstream side of the metering panel. This method of assembly is far simpler since it dispenses with the need of fitting and securing bolt-type fastenings or similar means from the side of the combustion chamber interior. The removable cowling provides for free, undisturbed access to the assembly areas. Providing the cowling as an extra, removable, separate component enables the entire combustion chamber head to be assembled without any problems. Moreover, it is not necessary to provide the cowling with assembly openings or similar means as known in the prior art. Rather, the present invention provides for free, unhindered access to the upstream side of the metering panel.

A particularly favourable feature of the design according to the present invention is that the sleeves are installed from the upstream side of the metering panel. This feature provides for re-location of the sliding and sealing face away from the metering panel, enabling cooling air to reach also the inner areas of the heat shield without problems. This provides for more effective and improved cooling.

In a particularly favourable development of the present invention, the heat shield is provided with stud bolts which can be led through openings in the metering panel. Separate bolts or similar means are, therefore, dispensable. Attaching the stud bolts to the heat shield also ensures high operational safety by avoiding the risk of parts coming off and entering the combustion chamber interior during operation.

In accordance with the present invention, the sleeve is preferably attached by means of retainers on the metering panel. In a favourable development of the present invention, these retainers are attached to the stud bolts of the heat shield. Additional bolts or threaded fastenings can, therefore, be entirely dispensed with. The entire construction is simplified considerably.

In a particularly favourable arrangement, each retainer holds two adjacent sleeves.

This allows for smaller retainers, with each retainer required to cover only a partial area of the sleeve. This arrangement is also beneficial in terms of the supply of cooling air.

For maximum simplicity of attachment of the cowling, at least one stud bolt is provided on the retainers. Thus, the cowling can simply be put onto the studs and bolted from the exterior.

For attachment and positioning of the cowling it is particularly favourable to locate the rim of the cowling in a groove in the metering panel. This design safely retains and centers the cowling. Furthermore, the groove will restrain the cowling in the case of a bird strike. The restraint provided by this design will, in this case, prevent the simply designed sheet-metal part from plainly bending out by enabling it to transform much more energy into deformation work, thereby reducing the degree of deformation and ensuring the continued operation of the combustion chamber head for the remaining operating time.

According to the present invention, the metering panel is provided with a plurality of cooling air holes, as known in the state of the art.

To improve the cooling of the heat shield, it can be favourable to provide it with a rim which abuts a collar of the sleeve, this rim extending in the upstream direction and being led through an opening in the metering panel. The height of the rim is selected such that, in the installed condition, the rim extends appropriately beyond the upstream side of the metering panel, thereby allowing the cooling air to freely access the central zone of the heat shield even if the collar of the sleeve abuts the cylindrical rim.

The design according to the present invention enables a defined gap to be provided between the outer wall of the cylindrical rim of the sleeve and the inner wall of the rim of the heat shield, this gap permitting a radial and circumferential relative movement of a fuel nozzle and the combustion chamber head. The size of the collar of the sleeve exceeds the outer diameter of the rim of the heat shield by the max. possible amount of movement, this feature enabling the space before the metering panel to be sealed to the combustion chamber against undesired leakage air even if the max. possible movement of the sleeve should take place. This provides for advantageous assembly and operating conditions.

Furthermore, the gaps between the sleeve and the retainers are particularly advantageous since they provide for sufficient clearance necessary for thermal compensation. On the other hand, provision is made for the secure positioning of the sleeve. The sleeve is securely and adequately positioned by the left or right part, respectively, of the adjacent retainers. Accordingly, each retainer secures two adjacent sleeves. As already mentioned, the retainer itself is fitted to the stud bolts of the heat shield and secured to the metering panel with appropriate nuts. In accordance with this invention, the retainer can accordingly also be designed as a support for the cowling, as already mentioned in the above.

The design proposed in the present invention enables the individual components to be separately manufactured and safely assembled. This provides for a high degree of flexibility also in terms of the candidate manufacturing processes and materials.

BRIEF DESCRIPTION OF THE DRAWINGS

The invention is more fully described in the light of the accompanying drawings showing an embodiment of the present invention. On the drawings.

DETAILED DESCRIPTION OF THE INVENTION

Figure 1:
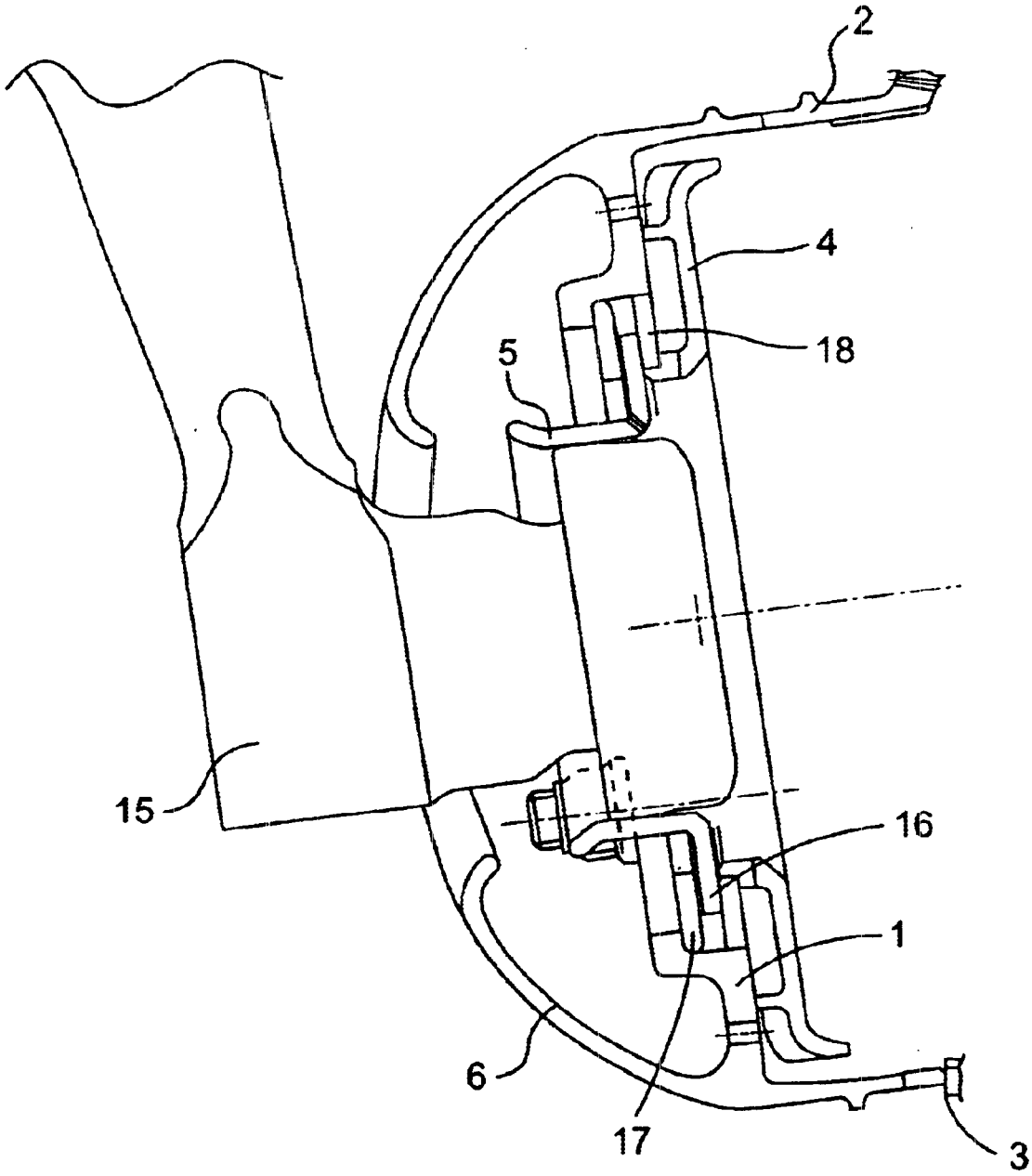
FIG. 1 PRIOR ART
FIG. 1 is a design of a combustion chamber head in accordance with the state of the art.

FIG. 1 shows the design according to the state of the art in which a combustion chamber outer wall 2 and a combustion chamber inner wall 3 forms a one-part design with a metering panel 1. Also, the metering panel 1 forms one part with a cowling 6. A heat shield 4 is fastened to the metering panel by means of bolts not further illustrated. The heat shield 4 also holds a sleeve 5. A collar 16 on the sleeve 5 locates against the metering panel 1 with pre-tension provided by an interposed spacer 17. A burner 15 is inserted in the sleeve 5.

Apparently, this type of combustion chamber head is expensive and difficult to assemble. The cowling 6 must be provided with appropriate assembly openings (not shown) to enable the bolt-type fastenings to be made. Furthermore, the position of the sleeve 5 or the heat shield 4, respectively, relative to the metering panel 1 is to be adjusted. For this purpose, the heat shield 4 is to be set by means of a washer 18.

FIGS. 2 to 6 illustrate an embodiment according to the present invention.

Figure 2:
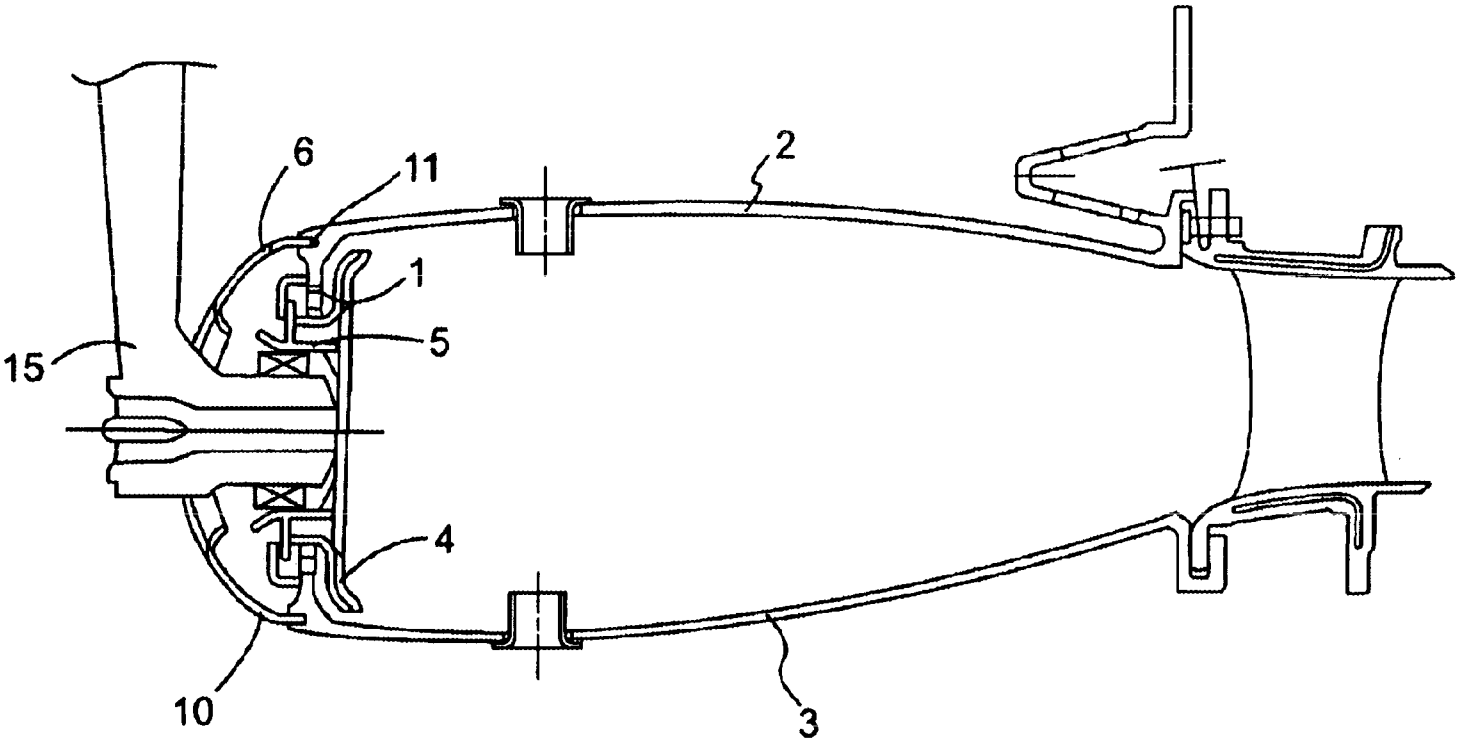
FIG. 2 is a simplified sectional side view of an embodiment of a combustion chamber according to the present invention with a combustion chamber head according to the present invention.
Figure 3:
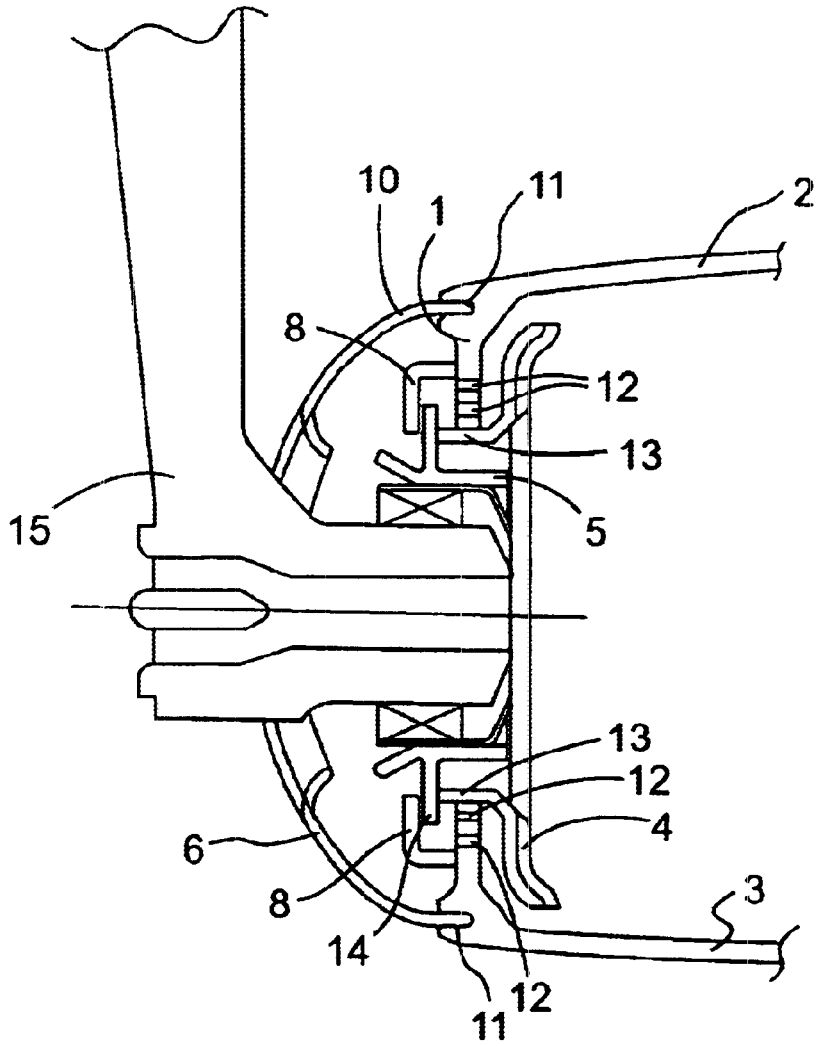
FIG. 3 is an enlarged partial view of the combustion chamber head of FIG. 2.
Figure 4:
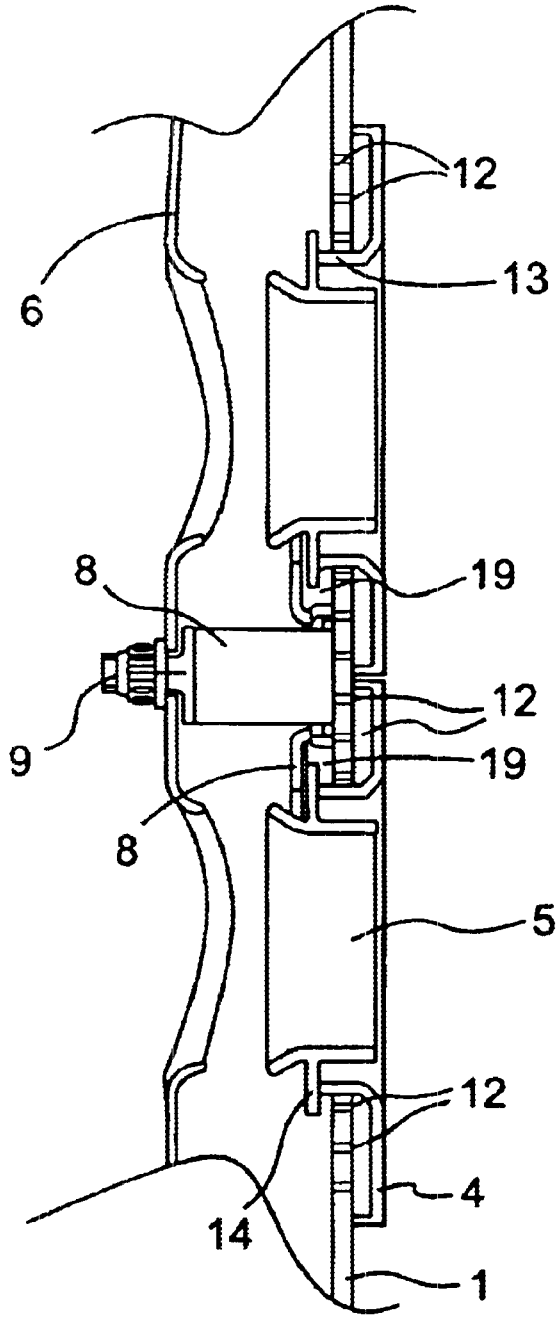
FIG. 4 is a sectional view of a combustion chamber head showing multiple heat shields and sleeves.

FIG. 2 is a schematic sectional side view showing, in simplified representation, an annular combustion chamber with a combustion chamber outer wall 2 and a combustion chamber inner wall 3. The metering panel 1 forms one part with the combustion chamber walls 2 and 3 and contains appropriate openings enabling cylindrical rims 13 of a heat shield 4 to be led through (ref. FIGS. 3 and 4).

As becomes apparent from the illustrations in FIGS. 3 and 4, in particular, the rim 13 of the heat shield 4 extends upstream in the axial direction. A sleeve 5 with an annular collar 14 abuts the rim 13 of the heat shield 4. As already mentioned, the diameter of the collar 14 is designed such that the sleeve 5 can move in the sideward direction relative to the metering panel 1 or the heat shield 4, respectively, without incurring the risk of undesired cooling air leakage.

Figure 5:
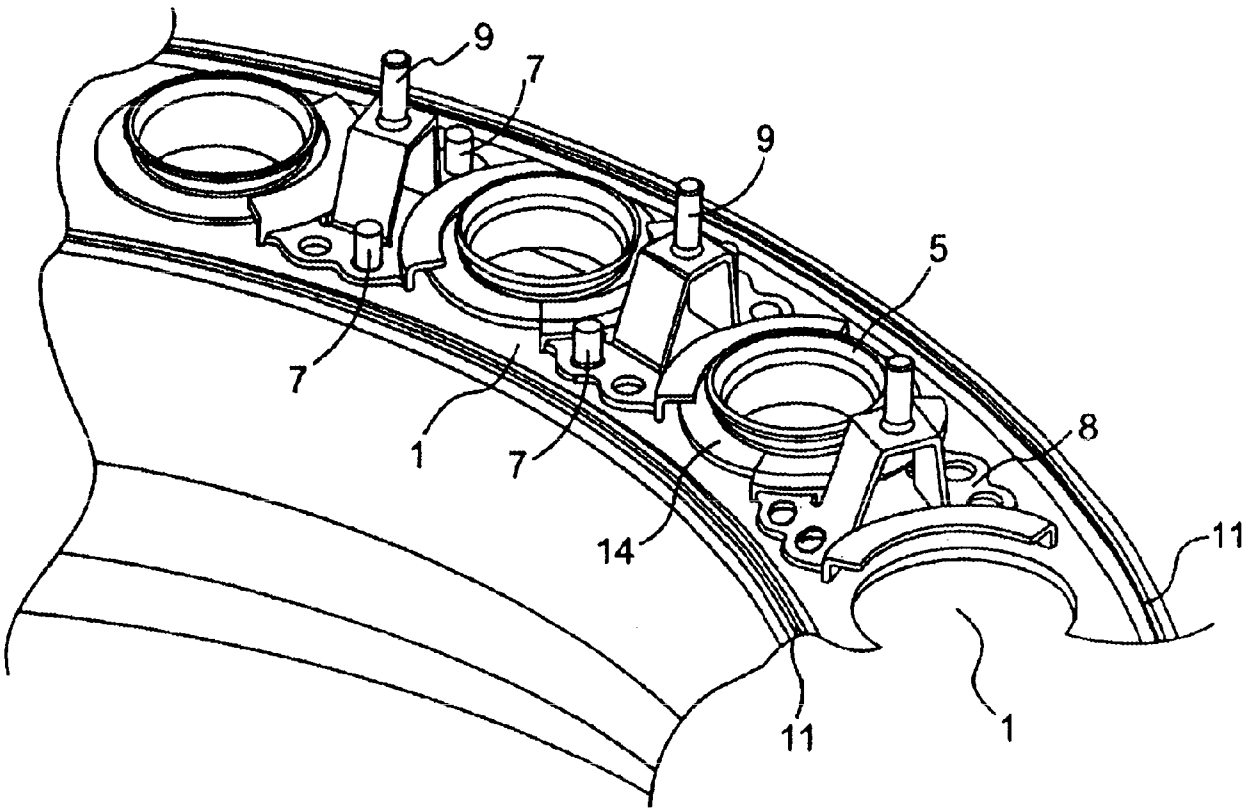
FIG. 5 is a perspective partial view similar to FIG. 4 of the upstream area of the metering panel with the multiple sleeves and retainers.

As becomes apparent from FIG. 5, in particular, the heat shield 4 features several stud bolts 7 (of which only some are shown in FIG. 5 for clarity purposes). The stud bolts 7 pass through openings of the metering panel 1 and of the bases of the retainers 8, thereby providing for a common bolt-type connection of the retainers 8 and of the heat shield 4 to the metering panel 1.

Figure 6:
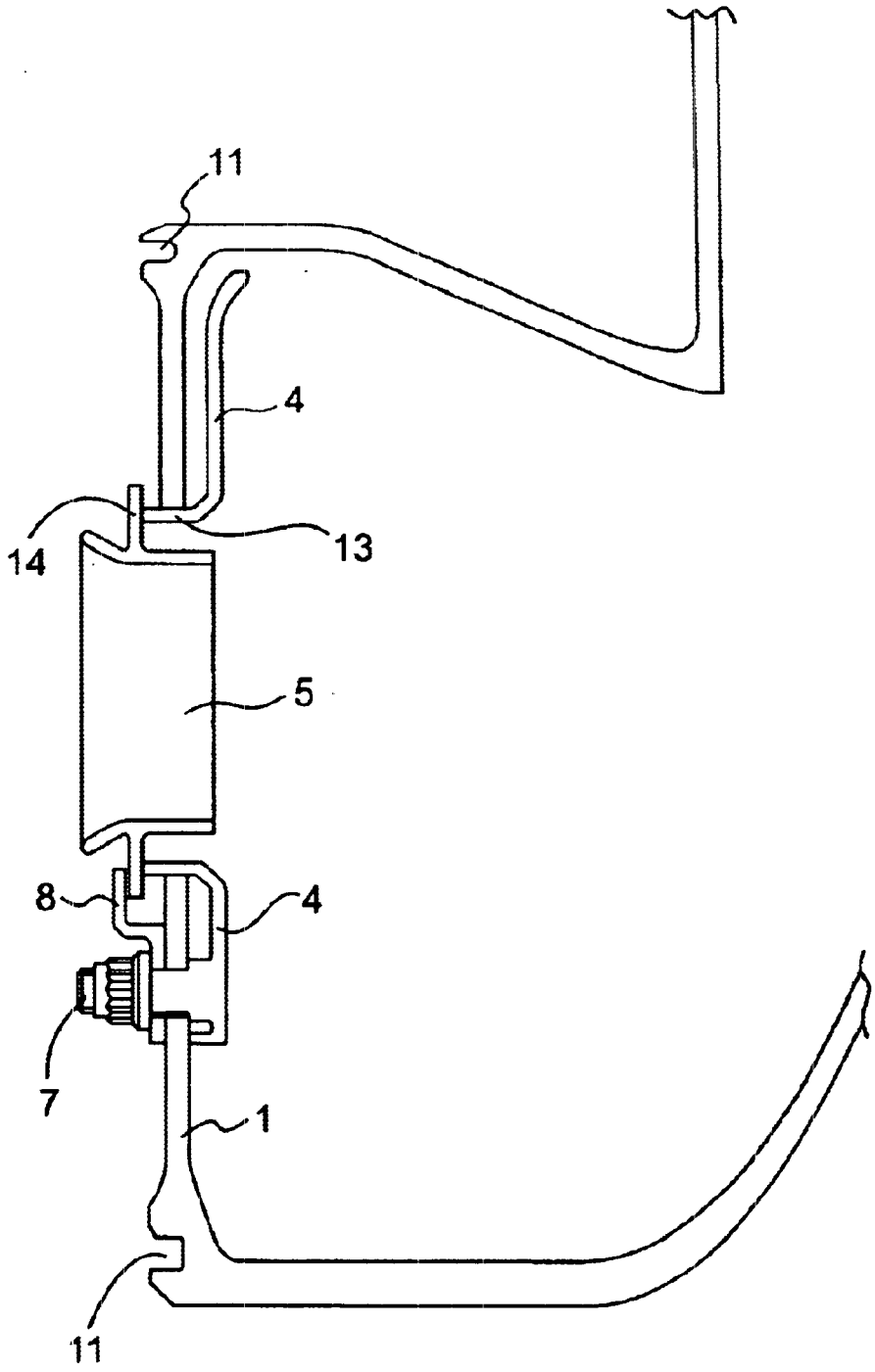
FIG. 6 is a simplified sectional side view of the metering panel and the heat shield showing the attachment of the heat shield by means of stud bolts.

FIG. 6 is a sectional view, similar to FIG. 4, in which the sectional plane is passed through at least one of the stud bolts 7 of the heat shield 4 to elucidate the bolt-type connection of the heat shield 4 to the metering panel 1 by means of the stud bolts 7 with the retainers 8 interposed.

In their centric area, each of the retainers 8 features a stud bolt 9 which serves for the attachment of the cowling 6, as shown in FIG. 4.

The metering panel 1 contains annular grooves 11 (ref. FIG. 5), each accommodating a rim 10 of the cowling 6 (FIG. 3).

As becomes apparent from FIG. 4, the metering panel features a plurality of cooling air holes 12, as known from the state of the art. The arrangement according to the present invention provides for sufficient spaces to supply cooling air to the heat shield 4.

As becomes apparent from the Figures, the combustion chamber head according to the present invention provides for the supply of cooling air to the heat shield 4 through openings in the cowling 6, both directly via the cooling air holes 12 of the metering panel 1 and, in the area of the sleeve 5, via the spaces 19 formed by the rim 13 of the heat shield 4 and the collar 14 of the sleeve 5 beneath the retainer 8 through the cooling air holes 12 of the metering panel 1.

The design proposed in the present invention, therefore, simplifies the assembly of the sleeves by providing a removable cowling. Furthermore, the cooling air for the heat shield can be supplied closely to the central bore of the heat shield. This provides for efficient cooling of all zones of the heat shield. The present invention also provides for a design of heat shield in which the air mass flow between the heat shield and the metering panel can be passed to the outside via the entire rearward surface of the heat shield, this air being used, on its further route, as starter film for the combustion chamber walls. Accordingly, the benefits of this invention are, on the one hand, the simplified assembly which results in a considerable reduction of costs and, on the other hand, the improved cooling of the heat shield which results in an increase of life and a saving of cooling air. The cooling air which is saved over the state of the art can, for instance, be integrated in the combustion process, this resulting in an additional pollutant reduction.

Generally, a plurality of modifications may be made to the embodiment shown without departing from the inventive concept expressed.

Summarizing, then, the present invention relates to a combustion chamber head for a gas turbine with at least one combustion chamber wall 2,3, a metering panel 1, at least one heat shield 4, at least one sleeve 5 and a cowling 6, characterized in that the metering panel 1 forms one part with the combustion chamber outer wall 2 and the combustion chamber inner wall 3, in that the heat shield 4 is mounted onto the metering panel 1 from the downstream side of the metering panel 1, in that the sleeve 5 is mounted to the metering panel 1 from the upstream side, and in that the cowling 6 is separably (removably) attached to the metering panel 1.

LIST OF REFERENCE NUMERALS

1 Metering panel
2 Combustion chamber outer wall
3 Combustion chamber inner wall
4 Heat shield
5 Sleeve
6 Cowling
7 Stud bolt of 4
8 Retainer
9 Stud bolt of 8
10 Rim of 6
11 Groove of 1
12 Cooling air hole of 1
13 Rim of 4
14 Collar of 5
15 Burner
16 Collar
17 Spacer
18 Washer
19 Space

What is claimed is:

1. A combustion chamber head for a gas turbine, comprising:

a combustion chamber outer wall;

a combustion chamber inner wall;

a metering panel;

at least one heat shield;

at least one sleeve; and a cowling;

wherein the metering panel is formed as a unitary part with the combustion chamber outer wall and the combustion chamber inner wall, the heat shield is mounted to the metering panel from a downstream side of the metering panel, the sleeve is mounted to the metering panel from an upstream side of the metering panel, and the cowling is removably attached to the metering panel, and further comprising a plurality of retainers and a plurality of sleeves, with each retainer attaching two adjacent sleeves to the metering panel.

2. The combustion chamber head of claim 1, wherein the heat shield includes a plurality of stud bolts which can be inserted through openings in the metering panel.

3. The combustion chamber head of claim 2, wherein the retainer is attached to the stud bolts of the heat shield.

4. The combustion chamber head of claim 3, wherein each retainer includes at least one stud bolt for attaching the cowling.

5. The combustion chamber head of claim 4, wherein the metering panel includes a groove to accommodate a rim of the cowling.

6. The combustion chamber head of claim 5, wherein the metering panel includes a plurality of cooling air holes from the upstream side to the downstream side.

7. The combustion chamber head of claim 6, wherein the heat shield includes a rim which abuts a collar of the sleeve, the rim extending in an upstream direction through an opening in the metering panel.

8. The combustion chamber head of claim 7, wherein a height of the rim is sized to provide a cooling air passage space for cooling the heat shield.

9. The combustion chamber head of claim 8, wherein cooling air is routed through openings in the cowling to the heat shield via the cooling air holes in the metering panel and, in the area of the sleeve, through the cooling air passage space formed by the rim of the heat shield and a collar of the sleeve beneath the retainer and via the cooling air holes in the metering panel, the cooling air also being used downstream as a starter film for cooling at least one of the combustion chamber walls.

10. The combustion chamber head of claim 1, wherein the metering panel includes a groove to accommodate a rim of the cowling.

11. The combustion chamber head of claim 10, wherein the heat shield includes a rim which abuts a collar of the sleeve, the rim extending in an upstream direction through an opening in the metering panel.

12. The combustion chamber head of claim 11, wherein cooling air is routed through openings in the cowling to the heat shield via the cooling air holes in the metering panel and, in the area of the sleeve, through a cooling air passage space formed by the rim of the heat shield and a collar of the sleeve and via the cooling air holes in the metering panel, the cooling air also being used downstream as a starter film for cooling at least one of the combustion chamber walls.

13. The combustion chamber head of claim 1, wherein the heat shield includes a rim which abuts a collar of the sleeve, the rim extending in an upstream direction through an opening in the metering panel.

14. The combustion chamber head of claim 13, wherein cooling air is routed through openings in the cowling to the heat shield via cooling air holes in the metering panel and, in the area of the sleeve, through a cooling air passage space formed by the rim of the heat shield and a collar of the sleeve and via the cooling air holes in the metering panel, the cooling air also being used downstream as a starter film for cooling at least one of the combustion chamber walls.

15. A combustion chamber head for a gas turbine, comprising:

a combustion chamber outer wall;

a combustion chamber inner wall;

a metering panel;

at least one heat shield;

at least one sleeve; and p1 a cowling;

wherein the metering panel is formed as a unitary part with the combustion chamber outer wall and the combustion chamber inner wall, the heat shield is mounted to the metering panel from a downstream side of the metering panel, the sleeve is mounted to the metering panel from an upstream side of the metering panel, and the cowling is removably attached to the metering panel, the metering panel including a radially outer groove and a radially inner groove, the radially outer groove engaging substantially an entire circumference of both an inner and outer surface of a radially outer rim of the cowling and the radially inner groove engaging substantially an entire circumference of both an inner and outer surface of a radially inner rim of the cowling.

16. The combustion chamber head of claim 15, wherein the heat shield includes a plurality of stud bolts which can be inserted through openings in the metering panel.

17. The combustion chamber head of claim 16, wherein the retainer is attached to the stud bolts of the heat shield.

18. The combustion chamber head of claim 15, wherein the heat shield includes a rim which abuts a collar of the sleeve, the rim extending in an upstream direction through an opening in the metering panel.

19. The combustion chamber head of claim 18, wherein a height of the rim is sized to provide a cooling air passage space for cooling the heat shield.

20. The combustion chamber head of claim 19, wherein cooling air is routed through openings in the cowling to the heat shield via the cooling air holes in the metering panel and, in the area of the sleeve, through the cooling air passage space formed by the rim of the heat shield and a collar of the sleeve beneath the retainer and via the cooling air holes in the metering panel, the cooling air also being used downstream as a starter film for cooling at least one of the combustion chamber walls.

21. The combustion chamber head of claim 15, and further comprising a plurality of retainers and a plurality of sleeves, with each retainer attaching two adjacent sleeves to the metering panel.

22. The combustion chamber head of claim 21, wherein each retainer includes at least one stud bolt for attaching the cowling.

23. The combustion chamber head of claim 15, wherein the sleeve is attached to the metering panel with at least one retainer and each retainer includes at least one stud bolt for attaching the cowling.

* * * * *